US009824848B2

(12) United States Patent
Ikarashi

(10) Patent No.: US 9,824,848 B2
(45) Date of Patent: Nov. 21, 2017

(54) X-RAY GENERATING TUBE, X-RAY GENERATING APPARATUS, AND RADIOGRAPHY SYSTEM

(71) Applicant: CANON KABUSHIKI KAISHA, Tokyo (JP)

(72) Inventor: Yoichi Ikarashi, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 99 days.

(21) Appl. No.: 14/882,562

(22) Filed: Oct. 14, 2015

(65) Prior Publication Data

US 2016/0126053 A1 May 5, 2016

(30) Foreign Application Priority Data

Oct. 29, 2014 (JP) ..... 2014-220083

(51) Int. Cl.
*H01J 35/00* (2006.01)
*H01J 35/16* (2006.01)
*H01J 35/08* (2006.01)

(52) U.S. Cl.
CPC ..... *H01J 35/16* (2013.01); *H01J 35/08* (2013.01); *H01J 2235/087* (2013.01)

(58) Field of Classification Search
CPC ..... H01J 2235/087; H01J 35/08; H01J 36/16; H01J 35/16
See application file for complete search history.

(56) References Cited

U.S. PATENT DOCUMENTS

2002/0196900 A1 12/2002 Dinsmore
2012/0099701 A1 4/2012 Rogers et al.
2014/0056406 A1 2/2014 Yamazaki et al.
2014/0064447 A1* 3/2014 Ogura ..... H01J 35/16 378/62

FOREIGN PATENT DOCUMENTS

JP 58-44662 A 3/1983

OTHER PUBLICATIONS

Extended European Search Report dated Mar. 3, 2016, in corresponding EP Application No. 15190789.6 (6 pages).
Office Action dated Jan. 25, 2017, in counterpart CN application No. 201510700386.1 (14 pages).

* cited by examiner

*Primary Examiner* — Dani Fox
(74) *Attorney, Agent, or Firm* — Fitzpatrick, Cella, Harper & Scinto

(57) ABSTRACT

An X-ray generating tube includes: an anode including a target and an anode member electrically connected to the target; a cathode including an electron emitting source and a cathode member electrically connected to the electron emitting source; and an insulating tube joined at one end to the anode member and joined at the other end to the cathode member so that the target and the electron emitting portion face each other, in which an inner circumferential conductive film is formed on an inner surface of the insulating tube; an end surface conductive film extends from one edge of the inner circumferential conductive film on the one end side onto a surface of the one end of the insulating tube; and the end surface conductive film is sandwiched between the end surface and the anode member to be electrically connected to the anode member.

39 Claims, 4 Drawing Sheets

X-RAY GENERATING TUBE, X-RAY GENERATING APPARATUS, AND RADIOGRAPHY SYSTEM

BACKGROUND OF THE INVENTION

Field of the Invention

The present invention relates to an X-ray generating tube generating an X-ray applicable to, for example, medical equipment and non-destructive testing apparatus, and an X-ray generating apparatus and a radiography system that use the X-ray generating tube.

Description of the Related Art

X-ray generating tubes generate an X-ray by applying high voltage in a vacuum container, thus causing an electron source to emit an electron beam and creating a collision between electrons and a target made of a metal material that has a high atomic number, such as tungsten.

The voltage applied between a cathode, which includes the electron source, and an anode, which includes the target, is generally about 10 kV to about 150 kV, although varying depending on the use of the generated X-ray. The trunk of the vacuum container is built from an insulating tube that is made of an insulating material such as glass or a ceramic material in order to keep the interior under vacuum and to electrically insulate the cathode and the anode from each other.

When an X-ray generating tube is driven to cause the electron source to emit electrons, scattered electrons and secondary electrons are generated in the X-ray generating tube and are in some cases captured on the inner surface of the insulating tube to charge the inner surface. With the inner surface of the insulating tube charged, an electric field thereof disrupts the trajectory of an electron beam to change the irradiation points and focal spot size of the electron beam, and consequently changes the focal position and dose of an emitted X-ray. In addition, the location and amount of charge on the inner surface of the insulating tube vary depending on the distribution of points irradiated with the scattered electrons and secondary electrons, and the resultant difference in electric potential on the inner surface of the insulating tube may lead to a discharge that damages the insulating tube.

There is disclosed in Japanese Patent Application Laid-Open No. S58-44662 a technology of preventing the accumulation of electric charges by forming a conductive film that is made from fine metal particle groups and a glaze along the inner circumference of the insulating tube.

However, no particular consideration is given to the connection between a low conductivity film and the electrodes in Japanese Patent Application Laid-Open No. S58-44662. Accordingly, poor connection between the low conductivity film and the electrodes hinders the scattered electrons and the secondary electrons from freeing, thereby putting the conductive film itself into a charged state. The charged conductive film may disrupt the electron beam trajectory and change the X-ray output.

SUMMARY OF THE INVENTION

It is an object of the present invention to prevent charging of an inner surface of an insulating tube without fail by using a conductive film.

In order to achieve the above-mentioned object, according to a first embodiment of the present invention, there is provided an X-ray generating tube, including: an anode including: a target generating an X-ray upon an irradiation with an electron beam; and an anode member which is electrically connected to the target and which holds the target; a cathode including: an electron emitting source having an electron emitting portion configured to irradiate an electron beam to the target; and a cathode member electrically connected to the electron emitting source; and an insulating tube having a pair of ends in a tube axis direction, one end of which is connected to the anode member and the other end of which is connected to the cathode member so that the target and the electron emitting portion face each other, in which the anode further includes an inner circumferential conductive film, which is positioned on an inner surface of the insulating tube at a distance from the cathode, and an end surface conductive film formed on the one end of the insulating tube, and in which the inner circumferential conductive film is electrically connected to the anode member via the end surface conductive film.

According to a second embodiment of the present invention, there is provided an X-ray generating apparatus, including: the X-ray generating tube of the first embodiment of the present invention; and a drive circuit configured to apply a tube voltage between the anode and the cathode.

According to a third embodiment of the present invention, there is provided a radiography system, including: the X-ray generating apparatus of the second embodiment of the present invention; an X-ray detector configured to detect an X-ray that has been generated from the X-ray generating apparatus and transmitted through a subject; and a system control unit configured to control the X-ray generating apparatus and the X-ray detector in an integrated manner.

Further features of the present invention will become apparent from the following description of exemplary embodiments with reference to the attached drawings.

BRIEF DESCRIPTION OF THE DRAWINGS

FIG. 1A is a schematic structural diagram, FIG. 1B is an enlarged sectional view of an insulating tube and a part of an anode member around an outer circumferential tubular portion, and FIG. 1C is a plan view of an end surface of the insulating tube.

DESCRIPTION OF THE EMBODIMENTS

Figure 1A:
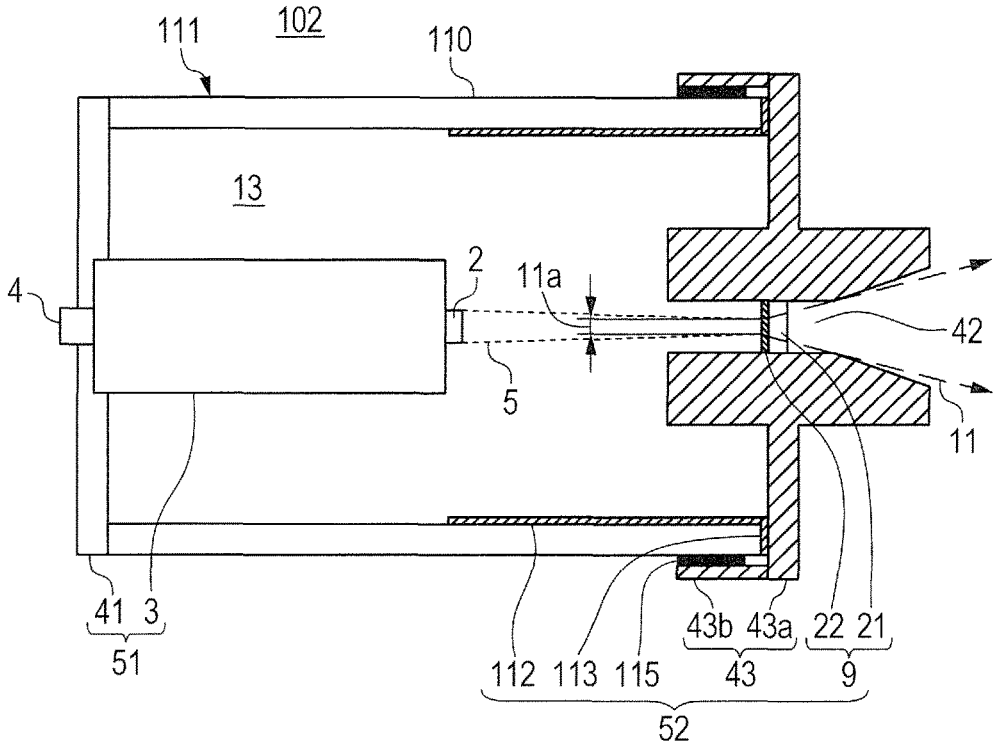
FIGS. 1A, 1B, and 1C are explanatory diagrams of an example of an X-ray generating tube according to the present invention.

An exemplary embodiment of the present invention is described in detail below with reference to the accompanying drawings. However, the dimensions, materials, shapes, relative arrangement, and the like of components described in this embodiment are not to limit the scope of the invention. The same reference symbols are used to denote the same components in the drawings described below.

<X-Ray Generating Tube>

FIG. 1A is an illustration of the schematic structure of a transmissive X-ray generating tube 102, which includes an electron emitting source 3 and a target 9.

A member which has airtightness for maintaining vacuum and which is solid enough to withstand atmospheric pressure is preferred for an envelope 111 of the X-ray generating tube 102. The envelope 111 of this embodiment includes an insulating tube 110, a cathode 51, which includes the electron emitting source 3 such as an electron gun, and an anode 52, which includes the target 9 held by a target holding portion 43*a* and an anode member 43. The cathode 51 and the anode 52 form a part of the envelope 111, with the anode member 43 joined to the insulating tube 110 at one end and a cathode member 41 joined to the insulating tube 110 at the other end. The target 9 has as a component a transmissive substrate 21 serving as a transmissive window through which an X-ray beam 11 generated by irradiating a target layer 22 with an electron beam is taken out of the X-ray generating tube 102, and which also forms a part of the envelope 111. It is preferred for the cathode member 41 and the anode member 43, which are joined to the insulating tube 110, to be made of a metal material that has a linear expansion coefficient close to that of the insulating tube 110. For example, Kovar (trademarked in the U.S. to CRS Holdings, Inc.) or Monel (trademarked in the U.S. to Special Metals Corporation) is used as the material. The insulating tube 110 and the joining of the anode member 43 to the insulating tube 110 are described later in detail.

The X-ray generating tube 102 generates the X-ray beam 11 by irradiating the target layer 22 of the target 9 with an electron beam 5, which is emitted from an electron emitting portion 2 included in the electron emitting source 3. A region 11*a* of the target layer 22 in which the X-ray is generated is called a focal spot of the X-ray beam 11. The target layer 22 is formed on the electron emitting source 3 side of the transmissive substrate 21 through which the X-ray is transmitted. The electron emitting portion 2 of the electron emitting source 3 is opposed to the target layer 22. For example, tungsten, tantalum, or molybdenum is used for the target layer 22.

The anode 52 of this embodiment includes the target 9, which generates an X-ray upon an irradiation with an electron beam, the target holding portion 43*a*, and the anode member 43, which defines the anode potential of the target 9. The anode member 43 includes the target holding portion 43*a* configured to hold the target 9, and an outer circumferential tubular portion 43*b*, which is provided in order to secure areal dimensions for joining the anode member 43 to the insulating tube 110. Metal such as Kovar, tungsten, molybdenum, or stainless steel is selected for the anode member 43, the outer circumferential tubular portion 43*b*, and the target holding portion 43*a*, which are included in the anode 52. Kovar, Monel, or the like is selected to give those components a linear expansion coefficient matching that of the insulating tube 110.

The outer circumferential tubular portion 43*b* is shaped like a sleeve that extends from the target holding portion 43*a* toward the cathode 51. The outer circumferential tubular portion 43*b* defines the anode potential of a cathode-side part of the anode 52. The distance from the target holding portion 43*a* to an end of the outer circumferential tubular portion 43*b* on the cathode 51 side is preferred to be constant in the circumferential direction from the viewpoint of in-plane symmetry of the anode-side electric potential distribution. The in-plane symmetry of the electric potential distribution means that the electric potential distribution in a plane parallel to the anode member 42 is continuous in a tube circumference direction, without finding a region that is locally high in electric field in the tube circumference direction.

The target holding portion 43*a* is joined to the target 9 to hold the target 9. The target holding portion 43*a* has a through-hole 42, and the opening of the through-hole 42 is closed to hold the target 9 at a point along the length of the through-hole 42. At least a part of the target holding portion 43*a* that extends outward from the target 9 to the outside of the envelope 111 is made of heavy metal such as tungsten or tantalum, or a material containing heavy metal, thereby enabling the target holding portion 43*a* to function as a collimator for controlling the emission angle of the X-ray beam 11. The target holding portion 43*a* and the outer circumferential tubular portion 43*b* may be formed as a seamless unitary member, or may be formed separately and subsequently joined together to form a unitary member.

The electron emitting source 3 is configured to irradiate the target 9 with an electron beam that is emitted from the electron beam emitting portion 2. For example, a hot cathode such as a tungsten filament or an impregnated cathode, or a cold cathode such as a carbon nanotube can be used for the electron emitting source 3. The electron emitting source 3 may include a grid electrode (not shown) and an electrostatic lens (not shown) for the purpose of controlling the beam diameter of the electron beam 5, the electron current density, on/off timing, and the like. Electrons contained in the electron beam 5 are accelerated to an energy level necessary to generate an X-ray in the target layer 22 by an accelerating electric field formed in an internal space 13 of the X-ray generating tube 102 which is sandwiched between the cathode 51 and the anode 52.

The internal space 13 of the X-ray generating tube 102 is vacuum in order to secure a mean free path for the electron beam 5. The degree of vacuum of the internal space 13 is preferably $10^{-8}$ Pa or more and $10^{-4}$ Pa or less, more preferably from the viewpoint of the lifetime of the electron emitting source 3, $10^{-8}$ Pa or more and $10^{-6}$ Pa or less. The internal space 13 of the X-ray generating tube 102 is put under vacuum by exhausting the internal space 13 with the use of an exhaust pipe (not shown) and a vacuum pump (not shown), and then sealing the exhaust pipe. A getter (not shown) may be formed in the internal space 13 of the X-ray generating tube 102 for the purpose of maintaining the vacuum.

The X-ray generating tube 102 has as its trunk the insulating tube 110 in order to electrically insulate the electron emitting source 3, which is set to the cathode potential, and the target layer 22, which is set to the anode potential, from each other. The insulating tube 110 is made of an insulating material such as a glass material or a ceramic material. The insulating tube 110 may have a function of defining the gap between the electron beam emitting portion 2 and the target layer 22.

Described next are the structure of the insulating tube 110, a joining structure for joining the anode 52 to the insulating tube 110, and a method of forming those structures.

Figure 1B:
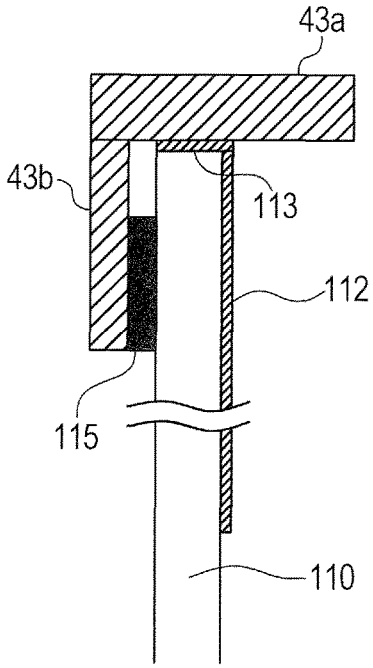
Figure 1C:
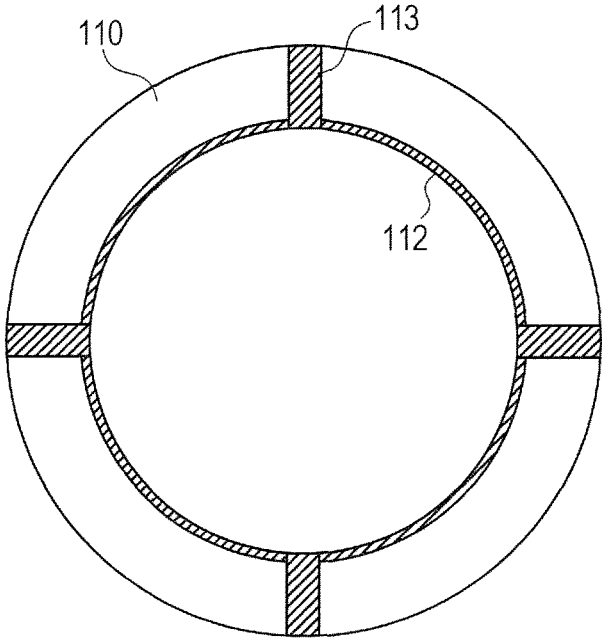

As illustrated in FIG. 1B and FIG. 1C, an inner circumferential conductive film 112 is formed on the inner circumferential surface of the insulating tube 110 at a distance from the cathode 51. The inner circumferential conductive film 112 is connected to the anode member 43 via an end surface conductive film 113, which extends from an edge of the inner circumferential conductive film 112 on the target holding portion 43*a* side onto an end surface of the insulating tube 110 on the target holding portion 43*a* side. The end surface conductive film 113 is sandwiched between the end surface of the insulating tube 110 on the target holding portion 43*a* side and the target holding portion 43*a* to be electrically connected to the anode member 43. Accordingly, when the components are viewed as nodes of the X-ray generating tube 102, it can be said that the inner circumferential conductive film 112, an outer circumferential conductive film 114, and the end surface conductive film 113 are included in the anode 52.

The inner circumferential conductive film 112 can be, for example, a film of metal such as silver, copper, tin, gold, zinc, titanium, molybdenum, manganese, chromium, aluminum, or magnesium, a conductive film that contains one of those metals, or a metal oxide film. The material of the inner circumferential conductive film 112 is selected by taking into consideration the adhesion to the inner surface of the insulating tube 110. The inner circumferential conductive film 112 can be formed by a method in which a paste that is a mixture of a conductive substance with an organic solvent, a binder, and the like is prepared and applied, an arbitrary deposition method such as vapor deposition or sputtering, or other methods.

A film preferred as the inner circumferential conductive film 112 has a thickness of from 100 nm to 500 μm, has sufficient conductivity, and is continuous in the tube circumference direction and a tube length direction so that the inner surface of the insulating tube 110 is not exposed within the extent of the inner circumferential conductive film 112. The preferred inner circumferential conductive film 112 is formed so as to stretch from the end of the insulating tube 110 on the target holding portion 43*a* side to a middle portion of the insulating tube 110 in the length direction as illustrated in FIG. 1A. It is preferred for an edge of the inner circumferential conductive film 112 on the cathode member 41 side, in particular, to be positioned at a point which overlaps with the electron emitting source 3 and which is on the target holding portion 43*a* side beyond the midpoint of the insulating tube 110 in a tube axis direction. This is for covering the inner surface of the insulating tube 110 which is likely to be subjected to reflected electrons, thus preventing reflected electrons from charging the insulating tube 110 and from causing discharge as a result, and maintaining the withstand voltage between the cathode 51 and the anode 52. The preferred inner circumferential conductive film 112 is formed continuously in the tube circumference direction and length direction of the insulating tube 110 so that the charging of a region where the inner circumferential conductive film 112 is formed is prevented evenly.

The end surface conductive film 113 can be formed from the same material, by the same method, and to the same thickness as the inner circumferential conductive film 112, and is formed so as to be continuous from the inner circumferential conductive film 112. In order to simplify the process and to facilitate the forming of a film that is continuous from the inner circumferential conductive film 112, it is preferred to form the end surface conductive film 113 at the same time as the inner circumferential conductive film 112.

The preferred end surface conductive film 113 is formed on a part of the end surface of the insulating tube 110 on the anode member 43 side in the tube circumference direction. For example, it is preferred to arrange a plurality of end surface conductive films 113 each having a width of from 100 μm to 5 mm discretely in two to ten places on the end surface of the insulating tube 110 as illustrated in FIG. 1C. Forming the end surface conductive film 113 only in selective places on the end surface of the insulating tube 110 is accomplished by a method in which a paste material is applied directly in places, a pattern printing method, a method in which a film is formed with a mask in place and then the mask is removed, or other methods.

A peripheral portion of the anode member 43 is opposed to the end surface of the insulating tube 110 where the inner circumferential conductive film 112 and the end surface conductive film 113 are formed in the manner described above, to join the anode member 43 to the insulating tube 110. With the end surface conductive film 113 formed only on a part of the end surface of the insulating tube 110 in the tube circumference direction, a pressure at which the end surface of the insulating tube 110 is nipped by the anode member 43 in the joining of the anode member 43 to the insulating tube 110 concentrates on the end surface conductive film 113. The resultant effect is that the anode member 43 is pressed strongly against the end surface conductive film 113, which increases the chance of contact between the end surface conductive film 113 and the anode member 43. Forming a plurality of end surface conductive films 113 discretely improves the probability of contact between the end surface conductive films 113 and the anode member 43 while maintaining the pressure concentration effect.

The inner circumferential conductive film 112 is physically connected to the anode member 43 via the end surface conductive film 113 in this manner, which improves the reliability of electrical connection between the inner circumferential conductive film 112 and the anode member 43. The anode member 43 is further connected as the anode 52 to a drive circuit 103, and is accordingly capable of freeing electric charges caused by scattered electrons and secondary electrons in the X-ray generating tube 102 to the outside via the inner circumferential conductive film 112 and the end surface conductive film 113. The X-ray generating tube 102 that is capable of preventing the charging of the inner surface of the insulating tube 110 and is reduced in changes in X-ray output is thus provided.

A material that is smaller in Young's modulus than the anode member 43 and the insulating tube 110 is preferred for the end surface conductive film 113. This causes the end surface conductive film 113 to be deformed so as to fit closely to the anode member 43, thereby improving the reliability of electrical connection between the end surface conductive film 113 and the anode member 43 even more. The insulating tube 110 is usually made of a glass material, a ceramic material, or the like as described above, and is larger in Young's modulus than metal. It is therefore recommended to use copper, silver, titanium, zinc, aluminum, or the like as the material of the end surface conductive film 113 while using Kovar, nickel, molybdenum, tungsten, or the like as the material of the anode member 43.

The insulating tube 110 and the anode member 43 are joined hermetically in order to keep the interior of the X-ray generating tube 102 under vacuum. In the example of FIG. 1A and FIG. 1B, an outer circumferential tubular portion 43*b* extends from the anode member 43 like a ring to surround the circumferential surface of the insulating tube 110 on the anode member 43 side. A joining member 115 interposed between the circumferential surface of the insulating tube 110 and the outer circumferential tubular portion 43*b* joins the anode member 43 and the insulating tube 110. Joining the anode member 43 and the insulating tube 110 in this manner keeps the airtightness in the envelope 111 of the X-ray generating tube 102 despite a gap equivalent to the thickness of the end surface conductive film 113 between the end surface of the insulating tube 110 and the anode member 43 in a region where the end surface conductive film 113 is not formed.

Hermetic joining is accomplished by brazing that uses brazing filler metal as the joining member 115. The brazing filler metal that can be used is, for example, one that has Au—Cu as the main component, nickel brazing filler metal, brass brazing filler metal, or silver brazing filler metal.

Other examples of the structure of the insulating tube and a part of the anode member around the outer circumferential tubular portion are described with reference to FIG. 2A and FIG. 2B.

Figure 2A:
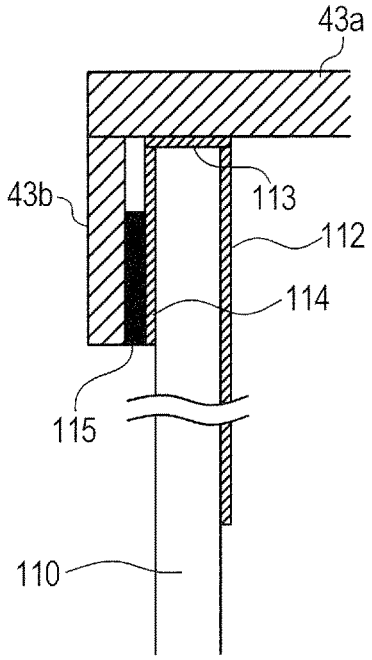
FIGS. 2A and 2B are each an enlarged sectional view for illustrating another example of the structure of the insulating tube and a part of an anode member around the outer circumferential tubular portion.

In the embodiment of FIG. 2A, the outer circumferential conductive film 114 that is electrically connected to the end surface conductive film 113 is formed on the circumferential surface of the insulating tube 110 on the anode member 43 side. The outer circumferential conductive film 114 is electrically connected to the outer circumferential tubular portion 43*b*. The joining member 115 hermetically joins the insulating tube 110 and the anode member 43 as in the embodiment described with reference to FIG. 1A to FIG. 1C. In this embodiment, however, the joining member 115 is sandwiched between the insulating tube 110 and the outer circumferential tubular portion 43*b*, in the state in which the outer circumferential conductive film 114 formed on the circumferential surface of the insulating tube 110 is sandwiched between the joining member 115 and the insulating tube 110. Forming the outer circumferential conductive film 114 improves the reliability of electrical connection between the inner circumferential conductive film 112 and the anode member 43 even more. The outer circumferential conductive film 114 may be formed intermittently in the tube circumference direction of the insulating tube 110 by extending the end surface conductive film 113 toward the circumference of the insulating tube 110, but it is preferred to form the outer circumferential conductive film 114 continuously along the entire circumference of the insulating tube 110 in order to facilitate the close fitting of the joining member 115 free of a gap. It is also preferred to form the outer circumferential conductive film 114 and the end surface conductive film 113 as a continuous film in order to ensure electrical connection therebetween.

The insulating tube 110 is preferred to have a ring-shaped region where the outer tube diameter increases in a tube axis direction that runs from an end of the insulating tube 110 on the anode member 43 side toward the other end of the insulating tube 110 on the cathode member 41 side. The ring-shaped region in the embodiment of FIG. 2B is a ring-shaped level difference 110*a*, which surrounds the inner circumferential conductive film 112. In the embodiment of FIG. 2B, the level difference 110*a* formed on the circumferential surface of the insulating tube 110 makes the outer diameter of the insulating tube 110 in a region of the insulating tube 110 on the cathode member 41 side larger than in its adjacent region on the anode member side. The outer circumferential tubular portion 43*b* faces the region on the anode member 43 side where the outer diameter is smaller, and the joining member 115 is sandwiched between the circumferential surface of the region where the outer diameter of the insulating tube 110 is smaller and the outer circumferential tubular portion 43*b*. This way, the level difference 110*a* dams up the joining member 115 that is melted for the joining by way of the joining member 115 and is flowing, and prevents the melted joining member 115 from flowing beyond the level difference 110*a* toward the cathode member 41 and impairing the withstand voltage between the cathode 51 and the anode 52. While the outer circumferential conductive film 114 is formed in FIG. 2A and FIG. 2B, the X-ray generating tube 102 may not include the outer circumferential conductive film 114.

<X-Ray Generating Apparatus>

Figure 3:
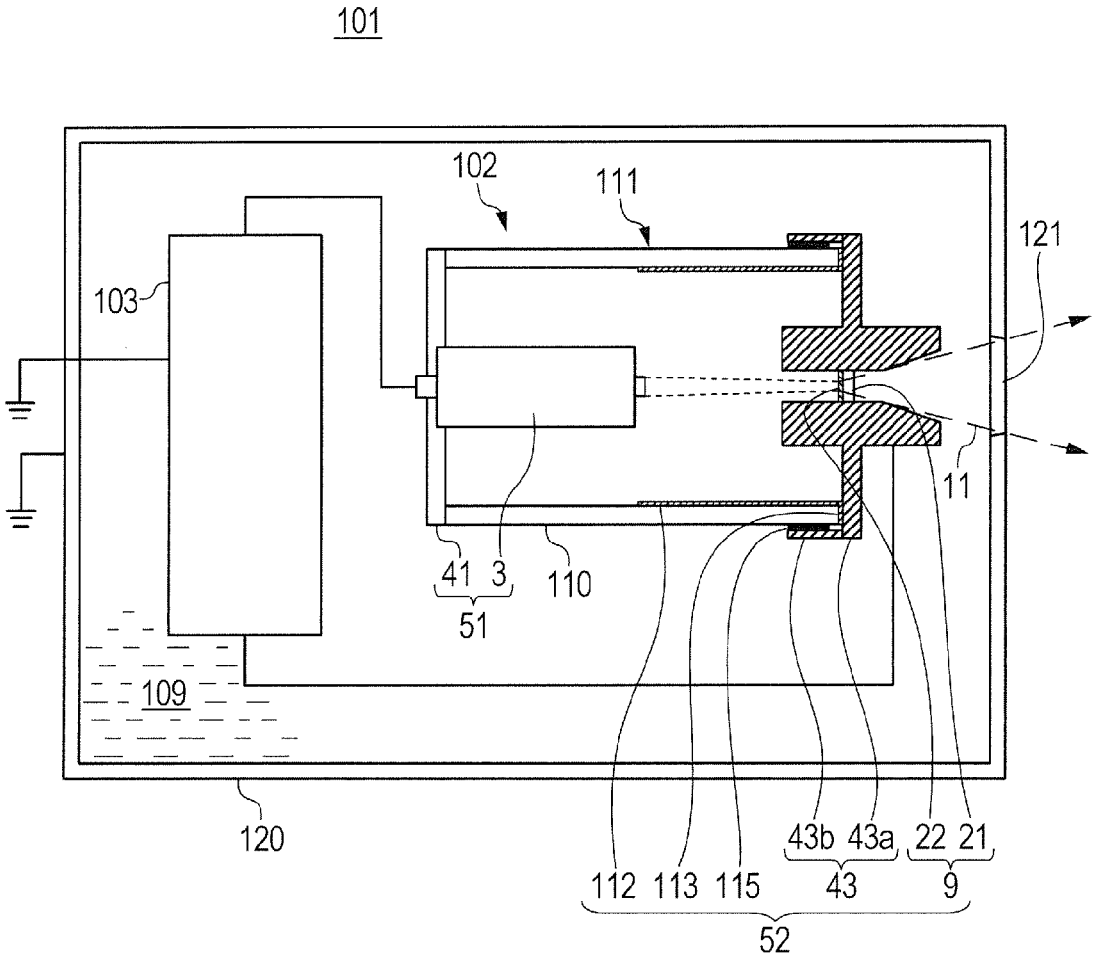
FIG. 3 is a schematic structural diagram for illustrating an example of an X-ray generating apparatus according to the present invention.

FIG. 3 is a diagram of an X-ray generating apparatus 101 according to the embodiment of the present invention, which is configured to take the X-ray beam 11 out to the front of an X-ray transmitting window 121. The X-ray generating apparatus 101 includes, in a container 120 where the X-ray transmitting window 121 is installed, the X-ray generating tube 102 and the drive circuit 103 for driving the X-ray generating tube 102. The drive circuit 103 applies a tube voltage Va between the cathode 51 and the anode 52 to form an accelerating electric field between the target layer 22 and the electron emitting portion 2. By setting the tube voltage Va that is suitable for the thickness of the target layer 22 and the type of metal forming the target layer 22, an X-ray type necessary for imaging can be selected.

The container 120, which houses the X-ray generating tube 102 and the drive circuit 103, desirably has strength sufficient as a container and excellent heat dissipating properties. The constituent material of the container 120 is, for example, a metal material such as brass, iron, or stainless steel.

An excess space in the container 120 which remains after the X-ray generating tube 102 and the drive circuit 103 housed in the container 120 take up spaces in the container 120 is filled with an insulating liquid 109. The insulating liquid 109 is a liquid having electrical insulation properties, maintains electrical insulation inside the container 120, and serves as a cooling medium for the X-ray generating tube 102. An electrical insulation oil such as a mineral oil, a silicone oil, or a perfluoro-based oil is preferred as the insulating liquid 109.

<Radiography System>

A structural example of a radiography system 60, which includes the X-ray generating tube 102 of the present invention, is described next with reference to FIG. 4.

A system control unit 202 controls the X-ray generating apparatus 101 and an X-ray detector 206 in an integrated manner. The drive circuit 103 outputs, under control of the system control unit 202, various control signals to the X-ray generating tube 102. The control signals output by the drive circuit 103 are used to control the emission state of the X-ray beam 11 emitted from the X-ray generating apparatus 101.

The X-ray beam 11 emitted from the X-ray generating apparatus 101 is adjusted in irradiation range by a collimator unit (not shown) having a variable aperture, emitted to the outside of the X-ray generating apparatus 101, transmitted through a subject to be examined 204 (hereinafter referred to as simply "subject"), and detected by the detector 206. The detector 206 converts the detected X-ray into image signals, which are output to a signal processing portion 205. The signal processing portion 205 performs, under control of the system control unit 202, given signal processing on the image signals, and outputs the processed image signals to the system control unit 202. Based on the processed image signals, the system control unit 202 outputs display signals for displaying an image on a display apparatus 203. The display apparatus 203 displays on a screen an image based on the display signals as a photographed image of the subject 204.

The radiography system 60 of the present invention is applicable to non-destructive testing of an industrial product, and the diagnosis of human and animal pathology.

Example 1

The X-ray generating tube 102 having the insulating tube 110 of FIG. 1A to FIG. 1C and the joining structure of FIG. 1A to FIG. 1C for joining the anode member 43 to the insulating tube 110 was manufactured and mounted to the X-ray generating apparatus 101.

As illustrated in FIG. 1B, the inner circumferential conductive film 112 was formed from a Ti—Cu-based material used as a ceramic metalizing material, on the inner circumferential surface of the insulating tube 110 that was made of alumina on the anode 52 side. As illustrated in FIG. 1C, the end surface conductive films 113 each having a width of 2 mm and continuous from the inner circumferential conductive film 112 were formed in four places on the end surface of the insulating tube 110 on the anode 52 side with use of the same material as the inner circumferential conductive film 112. The inner circumferential conductive film 112 and the end surface conductive films 113 were formed by preparing a paste that contained Ti—Cu-based powder, applying the paste directly to the insulating tube 110, drying the applied paste, and then executing vacuum heat treatment at 1,000° C. The thickness of the inner circumferential conductive film 112 and the end surface conductive films 113 after the heat treatment was 8 μm on average.

A silver brazing filler metal paste containing Ti was next applied to a part of the circumference of the insulating tube 110 that was in contact with the outer circumferential tubular portion 43*b*, and dried. Thereafter, components were arranged so as to bring the anode member 43 into contact with the end surface conductive films 113 formed on the insulating tube 110, and to bring the outer circumferential tubular portion 43*b* into contact with the joining member 115 formed on the circumference of the insulating tube 110, and vacuum heat treatment was executed at 800° C. for brazing. In the heat treatment, a weight was put on the anode member 43 in order to help along press-fit between the end surface conductive films 113 and the anode member 43. The metallization of alumina and hermetical brazing were accomplished by using brazing filler metal that contained Ti. The material used for the anode member 43 and the outer circumferential tubular portion 43*ba* was Kovar.

Figure 4:
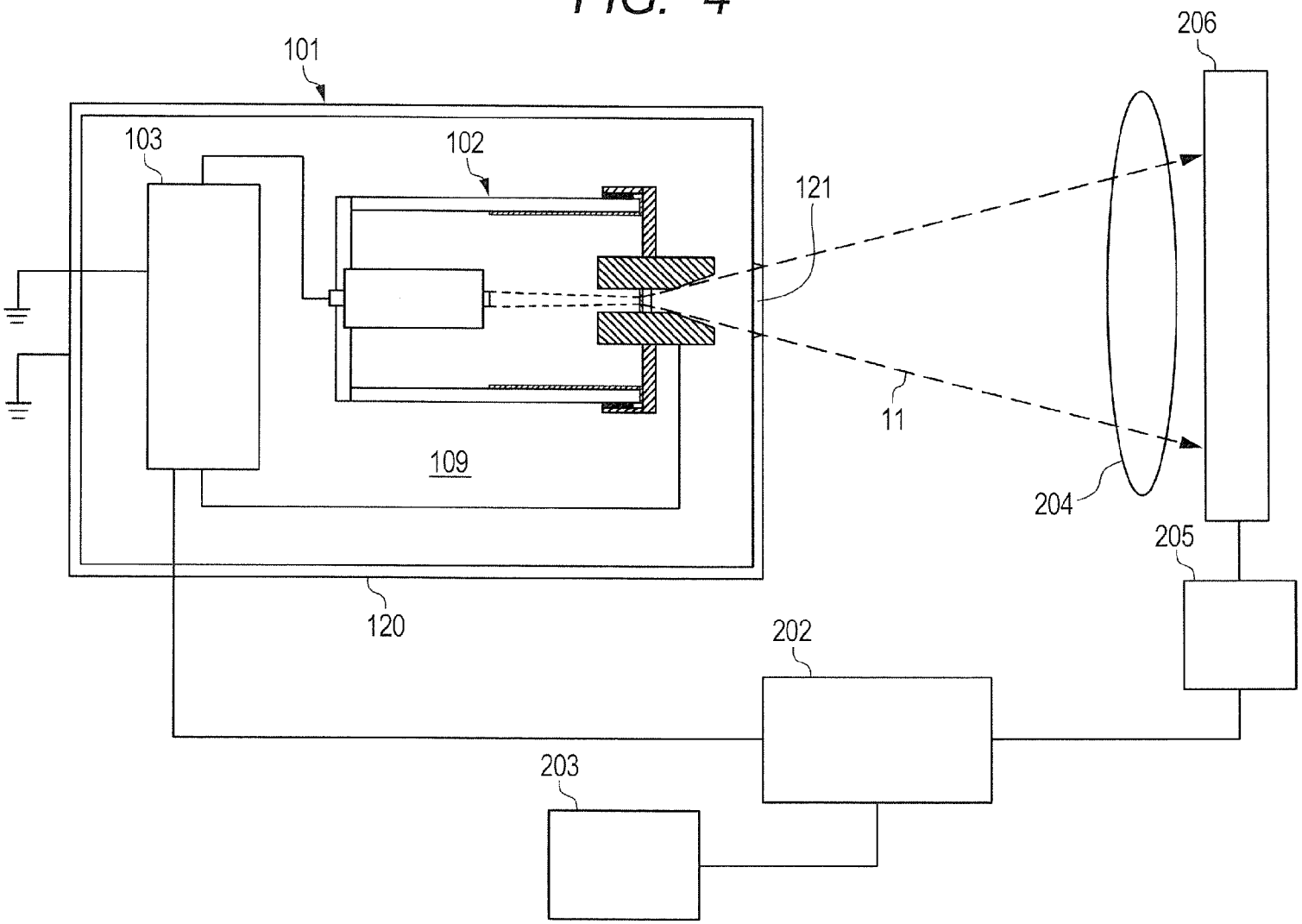
FIG. 4 is a schematic structural diagram for illustrating an example of a radiography system according to the present invention.

Next, the X-ray generating tube 102 of Example 1 was mounted to the radiography system 60 of FIG. 4, and changes in X-ray output were evaluated. The X-ray generating tube 102 was driven to evaluate changes with time of the position of the focal spot 11*a* of the X-ray beam 11. A favorable result was obtained in which the change in the center position of the focal spot 11*a* was 10 μm or less. The evaluation was made without placing the subject 204.

Comparative Example 1

For comparison with Example 1, the X-ray generating tube 102 that had no end surface conductive film 113 was manufactured. The rest of the structure and the method used to manufacture this X-ray generating tube 102 were the same as those in Example 1.

Changes in the position of the focal spot 11*a* of the X-ray beam 11 were evaluated next as in Example 1. It was found as a result that the center position of the focal spot 11*a* moved by 50 μm 30 minutes after the start of the driving. The cathode 51 was separated from the X-ray generating tube 102 after the completion of the evaluation, and a tester was used to measure an electric resistance value between the inner circumferential conductive film 112 on the anode 52 side and the anode member 43. The measured electric resistance value was 10 MΩ or more, which is equal to or more than a measurement limit.

It is therefore inferred that electrical connection was not established between the inner circumferential conductive film 112 and the anode member 43, and that gradual charging of the inner surface of the insulating tube 110 during the driving of the X-ray generating tube 102 bent the electron beam trajectory and caused the change in the position of the focal spot 11*a*.

Example 2

Figure 2B:
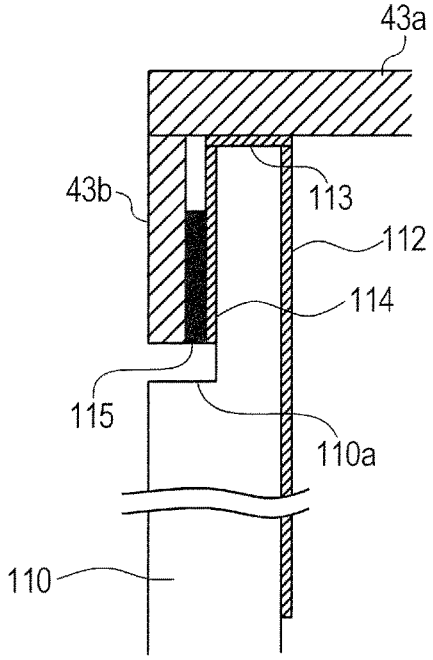

The X-ray generating tube 102 having the insulating tube 110 of FIG. 2B and the joining structure of FIG. 2B for joining the anode member 43 to the insulating tube 110 was manufactured and mounted to the X-ray generating apparatus 101.

As in Example 1, the inner circumferential conductive film 112 and the end surface conductive films 113 were formed from a Ti—Cu-based material, and the same material and the same method were used to form the outer circumferential conductive film 114 on the circumferential surface of the insulating tube 110 so as to be continuous from the end surface conductive films 113.

Next, a silver brazing filler metal wire was wound as the joining member 115 around the circumference of the insulating tube 110 in a part closer to the anode member 43 than the level difference 110*a*. Thereafter, components were arranged so as to bring the anode member 43 into contact with the end surface conductive films 113 formed on the insulating tube 110, and to bring the sleeve 43*a* into contact with the brazing filler metal 115 formed on the circumference of the insulating tube 110, and vacuum heat treatment was executed at 800° C. for brazing. In the heat treatment, a weight was put on the anode member 43 in order to help along press-fit between the end surface conductive films 113 and the anode member 43. The Ti—Cu-based outer circumferential conductive film 114 also acted to metallize alumina, and hermetical brazing was thus accomplished. Kovar was used as the material of the anode member 43. In the case where a brazing filler metal wire is used as the joining member 115, a groove portion (not shown) for holding the wire may be formed in the insulating tube 110 and the wire may be arranged in the groove portion.

Next, as in Example 1, the X-ray generating tube 102 of Example 2 was mounted to the radiography system 60, and changes in X-ray output were evaluated. A favorable result was obtained in which the change in the center position of the focal spot was 10 μm or less.

Example 3

In Example 3, the X-ray generating apparatus 101 of Example 1 was used to construct the radiography system 60 of FIG. 4. The radiography system 60 of Example 3 in which the X-ray generating apparatus 101 reduced in changes in X-ray output was provided was successful in yielding an X-ray photographed image high in SN ratio.

According to the present invention, electrical connection is made between the inner circumferential conductive film and the anode member via the end surface conductive film, which is sandwiched between an end surface of the insulating tube at one end and the anode member and which is electrically connected to the anode member. This improves the reliability of electrical connection between the inner circumferential conductive film and the anode member, and prevents without fail the charging of the inner surface of the insulating tube, thereby providing an X-ray generating tube that is reduced in changes in X-ray output. In addition, an X-ray generating apparatus and a radiography system that include the highly reliable X-ray generating tube reduced in changes in X-ray output can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-220083, filed Oct. 29, 2014, which is hereby incorporated by reference herein in its entirety.

What is claimed is:

1. An X-ray generating tube comprising:

an anode comprising:

a target generating an X-ray upon an irradiation with an electron beam; and an anode member which is electrically connected to the target and which holds the target;

a cathode comprising:

an electron emitting source having an electron emitting portion configured to irradiate an electron beam to the target; and a cathode member electrically connected to the electron emitting source; and an insulating tube having a pair of ends in a tube axis direction, one end of which is connected to the anode member and the other end of which is connected to the cathode member, wherein the anode further comprises an inner circumferential conductive layer located on an inner surface of the insulating tube at a distance from the cathode and an end surface conductive layer located on the one end of the insulating tube, wherein the inner circumferential conductive layer is electrically connected to the anode member via the end surface conductive layer, and wherein a plurality of the end surface conductive layers are located in a tube circumference direction of the insulating tube.

2. The X-ray generating tube according to claim 1, wherein the end surface conductive layer is sandwiched between the one end and the anode member.

3. The X-ray generating tube according to claim 1, wherein the inner circumferential conductive layer is located continuously in a tube circumference direction of the insulating tube and in a length direction of the insulating tube.

4. The X-ray generating tube according to claim 1, wherein the inner circumferential conductive layer is extended from the one end of the insulating tube.

5. The X-ray generating tube according to claim 1, wherein the end surface conductive layer has a smaller Young's modulus than the anode member and the insulating tube.

6. The X-ray generating tube according to claim 1, wherein the inner circumferential conductive layer and the end surface conductive layer form a continuous layer.

7. The X-ray generating tube according to claim 1, wherein a circumferential surface of the insulating tube is surrounded at the one end by an outer circumferential tubular portion extending from the anode member, and wherein the anode member is joined to the insulating tube by a joining member interposed between the circumferential surface of the insulating tube and the outer circumferential tubular portion.

8. The X-ray generating tube according to claim 7, wherein the insulating tube comprises, on the circumferential surface at the one end, an outer circumferential conductive layer electrically connected to the end surface conductive layer, and wherein the outer circumferential conductive layer is electrically connected to the outer circumferential tubular portion.

9. The X-ray generating tube according to claim 8, wherein the end surface conductive layer and the outer circumferential conductive layer form a continuous layer.

10. The X-ray generating tube according to claim 7, wherein the insulating tube comprises a ring-shaped region in which an outer tube diameter increases in a tube axis direction from the one end toward the other end.

11. The X-ray generating tube according to claim 10, wherein the ring-shaped region comprises a ring-shaped level difference that surrounds the inner circumferential conductive layer.

12. An X-ray generating apparatus comprising:

the X-ray generating tube of claim 1; and a drive circuit configured to apply a tube voltage between the anode and the cathode.

13. A radiography system comprising:

the X-ray generating apparatus of claim 12;

an X-ray detector configured to detect an X-ray that has been generated from the X-ray generating apparatus and transmitted through a subject; and a system control unit configured to control the X-ray generating apparatus and the X-ray detector in an integrated manner.

14. The X-ray generating tube according to claim 1, wherein the target and the electron emitting portion face each other.

15. An X-ray generating tube comprising:

an anode comprising:

a target generating an X-ray upon an irradiation with an electron beam; and an anode member which is electrically connected to the target and which holds the target;

a cathode comprising:

an electron emitting source having an electron emitting portion configured to irradiate an electron beam to the target; and a cathode member electrically connected to the electron emitting source; and an insulating tube having a pair of ends in a tube axis direction, one end of which is connected to the anode member and the other end of which is connected to the cathode member, wherein the anode further comprises an inner circumferential conductive layer located on an inner surface of the insulating tube at a distance from the cathode and an end surface conductive layer located on the one end of the insulating tube, wherein the inner circumferential conductive layer is electrically connected to the anode member via the end surface conductive layer, and wherein the end surface conductive layer has a smaller Young's modulus than the anode member and the insulating tube.

16. The X-ray generating tube according to claim 15, wherein the end surface conductive layer is sandwiched between the one end and the anode member.

17. The X-ray generating tube according to claim 15, wherein the inner circumferential conductive layer is located continuously in a tube circumference direction of the insulating tube and in a length direction of the insulating tube.

18. The X-ray generating tube according to claim 15, wherein the inner circumferential conductive layer is extended from the one end of the insulating tube.

19. The X-ray generating tube according to claim 15, wherein the inner circumferential conductive layer and the end surface conductive layer form a continuous layer.

20. The X-ray generating tube according to claim 15, wherein a circumferential surface of the insulating tube is surrounded at the one end by an outer circumferential tubular portion extending from the anode member, and wherein the anode member is joined to the insulating tube by a joining member interposed between the circumferential surface of the insulating tube and the outer circumferential tubular portion.

21. The X-ray generating tube according to claim 20, wherein the insulating tube comprises, on the circumferential surface at the one end, an outer circumferential conductive layer electrically connected to the end surface conductive layer, and wherein the outer circumferential conductive layer is electrically connected to the outer circumferential tubular portion.

22. The X-ray generating tube according to claim 21, wherein the end surface conductive layer and the outer circumferential conductive layer form a continuous layer.

23. The X-ray generating tube according to claim 20, wherein the insulating tube comprises a ring-shaped region in which an outer tube diameter increases in a tube axis direction from the one end toward the other end.

24. The X-ray generating tube according to claim 23, wherein the ring-shaped region comprises a ring-shaped level difference that surrounds the inner circumferential conductive layer.

25. The X-ray generating tube according to claim 15, wherein the target and the electron emitting portion face each other.

26. An X-ray generating apparatus comprising:

the X-ray generating tube of claim 15; and a drive circuit configured to apply a tube voltage between the anode and the cathode.

27. A radiography system comprising:

the X-ray generating apparatus of claim 26;

an X-ray detector configured to detect an X-ray that has been generated from the X-ray generating apparatus and transmitted through a subject; and a system control unit configured to control the X-ray generating apparatus and the X-ray detector in an integrated manner.

28. An X-ray generating tube comprising:

an anode comprising:

a target generating an X-ray upon an irradiation with an electron beam; and an anode member which is electrically connected to the target and which holds the target;

a cathode comprising:

an electron emitting source having an electron emitting portion configured to irradiate an electron beam to the target; and a cathode member electrically connected to the electron emitting source; and an insulating tube having a pair of ends in a tube axis direction, one end of which is connected to the anode member and the other end of which is connected to the cathode member, wherein the anode further comprises an inner circumferential conductive layer located on an inner surface of the insulating tube at a distance from the cathode and an end surface conductive layer located on the one end of the insulating tube, wherein the inner circumferential conductive layer is electrically connected to the anode member via the end surface conductive layer, wherein a circumferential surface of the insulating tube is surrounded at the one end by an outer circumferential tubular portion extending from the anode member, and wherein the anode member is joined to the insulating tube by a joining member interposed between the circumferential surface of the insulating tube and the outer circumferential tubular portion.

29. The X-ray generating tube according to claim 28, wherein the end surface conductive layer is sandwiched between the one end and the anode member.

30. The X-ray generating tube according to claim 28, wherein the inner circumferential conductive layer is located continuously in a tube circumference direction of the insulating tube and in a length direction of the insulating tube.

31. The X-ray generating tube according to claim 28, wherein the inner circumferential conductive layer is extended from the one end of the insulating tube.

32. The X-ray generating tube according to claim 28, wherein the inner circumferential conductive layer and the end surface conductive layer form a continuous layer.

33. The X-ray generating tube according to claim 28, wherein the insulating tube comprises, on the circumferential surface at the one end, an outer circumferential conductive layer electrically connected to the end surface conductive layer, and wherein the outer circumferential conductive layer is electrically connected to the outer circumferential tubular portion.

34. The X-ray generating tube according to claim 33, wherein the end surface conductive layer and the outer circumferential conductive layer form a continuous layer.

35. The X-ray generating tube according to claim 28, wherein the insulating tube comprises a ring-shaped region in which an outer tube diameter increases in a tube axis direction from the one end toward the other end.

36. The X-ray generating tube according to claim 35, wherein the ring-shaped region comprises a ring-shaped level difference that surrounds the inner circumferential conductive layer.

37. The X-ray generating tube according to claim 28, wherein the target and the electron emitting portion face each other.

38. An X-ray generating apparatus comprising:

the X-ray generating tube of claim 28; and a drive circuit configured to apply a tube voltage between the anode and the cathode.

39. A radiography system comprising:

the X-ray generating apparatus of claim 38;

an X-ray detector configured to detect an X-ray that has been generated from the X-ray generating apparatus and transmitted through a subject; and a system control unit configured to control the X-ray generating apparatus and the X-ray detector in an integrated manner.

* * * * *